US012421858B1

(12) United States Patent
Slipper et al.

(10) Patent No.: US 12,421,858 B1
(45) **Date of Patent: *Sep. 23, 2025**

(54) FLOW CONTROL DEVICE FOR AXIAL FLOW TURBOMACHINES IN SERIES

(71) Applicant: The United States of America, as represented by the Secretary of the Navy, Arlington, VA (US)

(72) Inventors: Michael E. Slipper, Ridley Park, PA (US); Tristan M. Wolfe, Philadelphia, PA (US); Kyle J. Verrinder, West Chester, PA (US)

(73) Assignee: The United States of America, as represented by the Secretary of the Navy, Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/588,516

(22) Filed: Feb. 27, 2024

Related U.S. Application Data

(63) Continuation of application No. 18/155,930, filed on Jan. 18, 2023, now Pat. No. 11,946,392, which is a continuation of application No. 16/670,426, filed on Oct. 31, 2019, now Pat. No. 11,585,227.

(51) Int. Cl.
*F04D 13/12* (2006.01)
*F01D 9/04* (2006.01)
*F04D 23/00* (2006.01)

(52) U.S. Cl.
CPC ..... *F01D 9/041* (2013.01); *F04D 23/005* (2013.01)

(58) Field of Classification Search
CPC . F04D 19/007; F04D 1/02; F04D 1/04; F04D 1/20; F04D 1/26; F04D 23/005; F04D 29/4226; F04D 29/4253; F04D 29/44; F04D 29/54; F04D 13/12; F04D 13/00; H05K 7/20172; F01D 13/00
See application file for complete search history.

(56) References Cited

U.S. PATENT DOCUMENTS

| | | | | |
|---|---|---|---|---|
| 2,037,395 | A | 4/1936 | Seelig | |
| 7,120,019 | B2 * | 10/2006 | Foster, Sr. | F04D 29/582 415/61 |
| 7,942,627 | B2 | 5/2011 | Jin | |
| 11,585,227 | B1 * | 2/2023 | Slipper | F01D 13/02 |
| 11,946,392 | B1 * | 4/2024 | Slipper | F04D 29/545 |

* cited by examiner

*Primary Examiner* — Nathaniel E Wiehe
*Assistant Examiner* — Maxime M Adjagbe
(74) *Attorney, Agent, or Firm* — Mark J. Rosen; Naval Surface Warfare Center, Philadelphia Division

(57) ABSTRACT

A flow control device for constraining fluid flow between axial flow turbomachines in series has a flow constrainer which constrains the fluid flow downstream of the first turbomachine in the series to the blades region of the second turbomachine, preventing fluid flow from impacting the hub or nosecone of the second turbomachine and providing more uniform fluid flow to the second turbomachine. The flow control device includes connective elements for positioning between the downstream region of the first turbomachine and the upstream region of the second turbomachine. The device may be equipped with stator vanes having a variety of optional configurations to further improve the uniformity of the fluid flow load on the second turbomachine.

17 Claims, 5 Drawing Sheets

Stator Vanes 5 topologies include:
Rectangle; Trapezoid; Ellipse; Airfoil

Flow constrainer 2 topologies include: Cylindrical; truncated conic; parabolic; semi-parabolic; hyperbolic; quadric; ogee; and compound

FLOW CONTROL DEVICE FOR AXIAL FLOW TURBOMACHINES IN SERIES

STATEMENT OF GOVERNMENT INTEREST

The invention described herein may be manufactured and used by or for the Government of the United States of America for governmental purposes without payment of any royalties thereon or therefor.

FIELD OF THE INVENTION

The invention is related to the field of generating fluid flow and fluid pressure using a series of axial flow turbomachines, more particularly, the invention presents improvements in the ability of axial flow turbomachinery in series to achieve such flow and pressure without certain disadvantages present in the art.

BACKGROUND OF THE INVENTION

Axial flow turbomachinery is used in many applications for generating flow and pressure of fluids. Fluids include liquids, such as water, and gases, such as air. Such axial flow turbomachinery may be present in fans, pumps, compressors, turbines, propellers, impellers, ducted propulsors, waterjets, fluid mixers, windmills, and the like.

Axial flow turbomachines are used to generate fluid flow and pressure in a wide variety of applications, including fresh air Heating Ventilation and Air Conditioning (HVAC) systems and other air or fluid delivery systems. The term "air" as used herein contemplates other gases, and the term "water" as used herein contemplates other liquids. While some embodiments of the invention herein are described with reference to the flow of a particular fluid, for example air, those of skill in the art will appreciate that the invention is applicable to a wide variety of other fluids, such as other gases and liquids.

An axial flow turbomachine produces axial flow, i.e., flow which is predominantly parallel with the axis of rotation. An axial flow turbomachine is typically a generally cylindrical assembly constructed from several components, including a rotating member at one end, known as the hub, whose axis of rotation is generally coaxial with the axis of the cylindrical turbomachine assembly. The hub is equipped with a series of blades situate around its circumference, the hub with attached blades being known as a rotor, and the blades are angled and/or shaped to produce axial fluid flow when the rotor rotates. Viewed face-on looking in the direction of the hub, the blades region is an annular region surrounding the central hub.

A rotating rotor which impels fluid to flow may also be known functionally as an impeller. The impeller is set in rotational motion by a drive assembly, typically disposed at the other end of the turbomachine. The drive assembly extends a drive shaft to the rotor and connects therewith in the center of the rotor. The drive assembly rotates the drive shaft, which drives the rotor in rotational motion. In a direct drive turbomachine, the drive assembly has a motor rotating the driveshaft. Alternatively, in an indirect drive turbomachine, the motor may be disposed externally from the turbomachine assembly and attach to the drive assembly opposite the rotor via drive elements such as crankshafts, belts, gears, or other drive means.

Fluid approaches the incoming or inlet end of the axial flow turbomachine. This proximal or upstream end of the turbomachine features the hub, which hub may also have a nose cone attached thereto to improve the aerodynamics of fluid flow. The distal or downstream end of the axial flow turbomachine typically contains the drive assembly, which may have a motor or the drive elements for connecting to an external motor. The drive assembly is typically non-rotating, but may be rotating in certain applications. The drive assembly end is typically cylindrical, but other shapes may be used in different applications. The impeller generates axial flow of the fluid toward the downstream end of the turbomachine.

Typically, axial flow turbomachines used for delivering pressurized fluid are disposed in a coaxial cylindrical housing, which is joined at both ends to pipes, conduits, or other similar ducting via flanges on the housing and matching flanges on the ducting. At the turbomachine inlet end, fluid flows from the ducting toward the axial flow turbomachine disposed in its housing. The fluid passes around the hub and meets the blades, which accelerates the fluid such that pressurized fluid flows downstream from the impeller. Depending on the intended destination and use of the pressurized fluid, non-rotating stator vanes may be advantageously disposed immediately downstream of the impeller to straighten the fluid flow, or to impart other desirable flow patterns.

The flow and pressure produced by axial flow turbomachines are dependent on many factors, including the rotational velocity of the rotor, the dimensions and shape of the blades, the ratio of the hub radius (defined as the distance from the hub center of rotation to its outer circumference at the base of the blades) to the tip radius (defined as the distance from the hub center of rotation to the tips of the blades), and characteristics of the spaces leading toward (upstream) and away (downstream) from the turbomachines. The ratio of hub radius to tip radius, known as hub to tip ratio (HTR), is an important factor in determining the performance characteristics of an axial flow turbomachine. Where the HTR is low, i.e., the hub radius is significantly smaller than the tip radius, the tips of the blades move at substantially greater velocity than the portion of the blades near the hub. The generated fluid flow is likewise highest at the tips and lowest near the base of the blades attached to the hub. The overall pressure such a low HTR turbomachine is capable of delivering is compromised by the weaker performance of the portions of the blades near the hub. Conversely, where the HTR is high, i.e., the hub radius is relatively large compared to the tip radius, the tips of the blades move at nearly the same velocity as the portions of the blades near the hub. This characteristic allows higher HTR axial flow turbomachines to achieve higher pressures than lower HTR axial flow turbomachines.

The incoming fluid arrives at the proximal end of the turbomachine at the hub, and the impeller. Downstream from the impeller the fluid flows downstream around and over any portion of the turbomachine assembly extending past the rotor, until it reaches the distal end of the turbomachine (typically the drive assembly end), at which point the fluid fills the otherwise empty space in the housing and proceeds further downstream. The hub at the proximal end of a second axial flow turbomachine frequently has a different diameter than the distal end of the first turbomachine depending on the design of the axial flow turbomachine's drive assembly. For high HTR axial flow turbomachines, for example, typically the hub will be larger than the downstream end of the turbomachine.

In some applications for axial flow turbomachines, maximizing fluid flow is more important than maximizing fluid pressure. In other applications, maximizing fluid pressure is of greater importance than fluid flow. Those of skill in the art will appreciate selecting an axial flow turbomachine with an HTR suitable for the intended purpose.

Where the physical space available to place an axial flow turbomachine is not restrictive, a turbomachine may be sized optimally to achieve the desired flow and pressure. Axial flow turbomachines may be used to deliver fluid at high pressures. Depending on the application, space may be at a premium and the space available for turbomachines tasked with generating the pressures required is limited. Where the physical space available is limited, the performance characteristics of a single axial flow turbomachine optimized for such a limited space may still be insufficient to produce the desired flow and pressure. That is, a single axial flow turbomachine may struggle to achieve the desired pressures simply because the space available for the turbomachine is restricted. Even when the HTR is high, the blades are adapted for maximum pressure performance, and the rotor velocity is maximized, the turbomachine's size may still be incapable of generating the desired pressure. In such cases, it may be necessary to use two separate axial flow turbomachines to achieve the required flow and pressure. Depending on the purpose, two or more axial flow turbomachines may be used in parallel or in series.

Axial flow turbomachines may be employed in series when pressure requirements exceed the capability of a single axial flow turbomachine and/or when two smaller turbomachines fit the available space better than one larger turbomachine. Typically, the second axial flow turbomachine in its housing would be placed at an advantageous distance downstream of the first axial flow turbomachine in its housing. Turbomachines in series are currently constructed in several different ways. Some are bolted directly to one another in a rigid arrangement. Others have a rigid duct positioned between them. Still others have a flexible connection between the two turbomachines. Flexible ducting under high velocities may be prone to pressure "necking" the connection and thereby starving the rotor blade tips.

In all of these arrangements, however, there are concomitant problems generated by the non-uniform flow of fluid from the downstream end of the first axial flow turbomachine to the upstream end of the second turbomachine. The non-uniform flow may have several components, including undesirable uncontrolled pre-rotational swirl ("pre-swirl"), counter-rotational swirl ("co-swirl"), vortices, and/or other irregular flow patterns of the fluid approaching the second axial flow turbomachine due to the flow dynamics of the fluid flowing downstream from the impeller of the first axial flow turbomachine. These non-uniform flow phenomena can have disadvantageous effects on the overall flow through the system or component, leading to degradation in performance of the system.

The non-uniform flow downstream of the first turbomachine in a series is less problematic when the turbomachines can be spaced at sufficiently large distances such that the flow becomes substantially more uniform by the time it reaches the second turbomachine. Generally, spacing the turbomachines at a distance greater than the diameter of the housing reduces the problem of non-uniform flow, although efficiency is still reduced by the effects of fluid flow impacting the hub of the second turbomachine. Non-uniform flow is particularly problematic, however, at smaller distances between the two turbomachines. In the context of requiring high pressure fluid but having only limited physical space, two axial flow turbomachines in series may need to be placed closer together than even the diameter of the housing, pipe, duct, or conduit. Non-uniformity flow problems arise because much of the fluid downstream of the first turbomachine is free to migrate from the periphery and impact the hub region of the second turbomachine. These irregular flow problems create uneven loading conditions and non-uniform fluid flow reaching the second turbomachine, including swirls, vortices, vibrations, and the like. This uneven loading creates stresses within the system including vibrations, noise, fatigue in welds and mechanical joints, loosening of fittings and more, further degrading the overall soundness of the system as a whole and ultimately increasing the likelihood of mechanical failures. The efficiency of the system is thus adversely affected.

High pressure fluid flow may be achieved by using two (or more) high HTR axial flow turbomachines in series as described above. In the ducting and piping systems, and at the pressures such axial flow turbomachines operate, however, the fluid flow is particularly prone to non-uniformity as the fluid exiting downstream from the first turbomachine impacts not only the blades of the second turbomachine but the relatively larger hub in a high HTR system as well, even when the hub is equipped with a nose cone.

In previous attempts to mitigate and minimize non-uniform flow, a length of duct or a flexible expansion joint has been constructed between two turbomachines in series. Such attempts have had only limited success at reducing non-uniform flow, but at the cost of a decrease in pressure for the entire system. One means of better controlling the fluid flow is to use straightening devices such as stator vanes downstream of the impeller of the first turbomachine. Such vanes are capable of improving the fluid flow to a more uniform pattern, even aimed more or less directly at the inlet side of the second turbomachine. However, even a more directionally uniform fluid flow still impacts the center of the hub of the second turbomachine, thereby re-creating non-uniform flow and uneven loading, reducing efficiency, and reducing the level of pressure the series of axial flow turbomachines would otherwise be capable of producing. The effects of such hub impact is even more problematic with higher HTR turbomachines in close proximity.

The art is in need of improved ways to use axial flow turbomachines in series to generate desired pressures without the disadvantages of current designs.

SUMMARY OF THE INVENTION

Having observed the aforementioned problems with axial flow turbomachines in series, the inventors hereof have invented a flow control device to be mounted between axial flow turbomachines. The device constrains the fluid flow downstream from the first axial flow turbomachine to the periphery between the housing and turbomachine assembly, directing the fluid flow substantially completely to the impeller blades of the second turbomachine while preventing any significant impact of the fluid flow on the center of the second axial flow turbomachine's hub. The flow device of the invention thus mitigates and minimizes swirl and other non-uniform fluid flow problems, permitting the turbomachines in series to generate higher pressures, thereby improving the efficiency of the system, reducing the stress on the mechanical members thereof, and also minimizing the risk of mechanical failures. The device is also adaptable to provide additional functionality, including using stator vanes to straighten the fluid flow or impart desirable rotational motion to the fluid flow, providing isolation for vibration dampening between the two turbomachines, and reducing other undesirable artifacts such as noise, cavitation, and the like.

In one aspect, the invention is directed to a flow control device for constraining fluid flow between axial flow turbomachines in series having a flow constrainer with a first end and a second end, the first end having a diameter substantially equal to a diameter of a drive assembly of a first axial flow turbomachine housed in a first housing, and the second end having a diameter substantially equal to a diameter of a hub of a second axial flow turbomachine housed in a second housing. When the first and second housings are joined with the flow control device being situated between the first and second axial flow turbomachines, the flow constrainer occupies a volume defined by substantially all the space extending between the drive assembly of the first axial flow turbomachine and the hub of the second axial flow turbomachine. The flow control device constrains fluid flow downstream of the first axial flow turbomachine to the outer region of the rotor of the second axial flow turbomachine, particularly, the annular region where the blades of the hub of the second axial flow turbomachine impel the incoming fluid.

In some aspects, the first end of the flow constrainer is attached to the drive assembly of the first axial flow turbomachine and the flow control device is cantilevered toward the second axial flow turbomachine. The flow control device may have a plurality of stator vanes attached to its outer surface, the stator vanes having a cross section topology which may be a rectangle, a trapezoid, an ellipse, an airfoil, or other desirable topologies. The stator vanes may curve upon the outer surface of the flow constrainer.

In some aspects, the flow constrainer is constructed from a substantially rigid material. The functionally rigid material may be metal, plastic, rubber, resin, polymer, carbon fiber, and the like, or may be combinations of such materials.

In other aspects, the flow constrainer has a topology such as cylindrical, truncated conic, parabolic, semi-parabolic, hyperbolic, quadric, ogee, or compound (i.e., a combination of topologies).

In some aspects, the flow control device also has an outer ring coaxially concentric with the flow constrainer, the outer ring being connected to the flow constrainer by a plurality of struts, and the outer ring having attachment points for attaching to at least one of the first and second housings. In some aspects, the struts are stator vanes. Such stator vanes may have a cross section topology such as a rectangle, a trapezoid, an ellipse, an airfoil, or other desirable topologies. The stator vanes may also curve upon an outer surface of the flow constrainer.

In some aspects, the attachment points are flanges for attaching to the first and second housings. In other aspects, the attachment points are a plurality of threaded holes.

The flow control device of the invention is suitably used with a wide variety of fluids. In some aspects, the fluid is liquid, such as water or seawater, while in other aspects the fluid is gaseous, such as air.

In some aspects, the drive assembly contains a motor, while in other aspects, the drive assembly contains drive elements connected to an external motor. Such drive elements may be crankshafts, belts, gears, and the like.

In some aspects, the flow control device is adapted to be positioned between two axial flow turbomachines in which the first and second housings for the turbomachines are both part of, or regions of, a single housing capable of housing multiple turbomachines.

In some aspects, the invention is directed to a method of constraining fluid flow between a first and a second axial flow turbomachine, the method being to mount between the turbomachines a flow control device as described herein, such that the fluid flow is constrained and directed to the blades of the second axial flow turbomachine.

These and other aspects of the invention will be readily appreciated by those of skill in the art from the description of the invention herein.

DETAILED DESCRIPTION OF THE INVENTION

Figure 2:
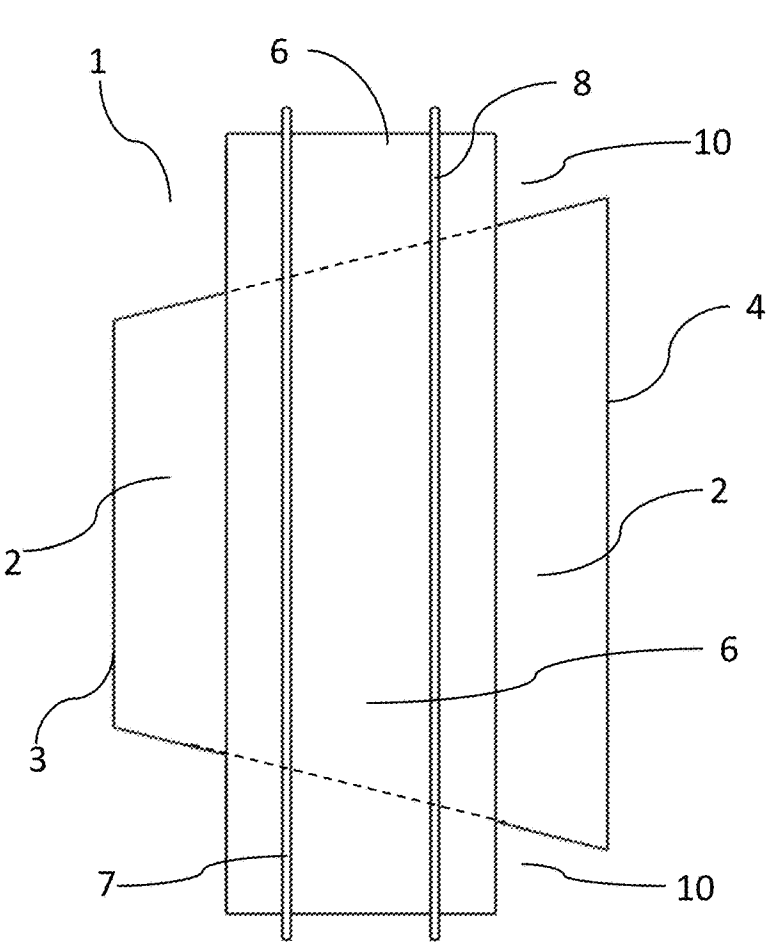
FIG. 2 depicts a side view of an embodiment of the flow control device for axial flow turbomachines in series.

The flow control device of the invention is designed to be mounted between axial flow turbomachines in series. The axial flow turbomachines are situated in housings which generally match in diameter the ducts, pipes, and conduits through which the fluid arrives at the turbomachines and leaves downstream under pressure generated by the turbomachines.

The flow constrainer is constructed such that the diameter of one end matches the outer diameter of the downstream end of the first axial flow turbomachine, while the diameter of the flow constrainer's other end matches the outer diameter of the second axial flow turbomachine's hub, whether or not the hub includes a nose cone. The ends of the flow constrainer need not make actual contact with either the distal end of the first axial flow turbomachine or the upstream hub end of the second axial flow turbomachine. The flow constrainer blocks and occupies a volume defined by substantially all the space extending between the downstream end of the first axial flow turbomachine's motor and the second axial flow turbomachine's hub (the "blocked space"), such that the flow control device prevents fluid flow within its occupied volume and thereby constrains fluid flow downstream of the first axial flow turbomachine only to an annular exit space defined by the outer surface of the flow constrainer and the inner surface of the housings. The annular exit space has approximately the same dimensions as the annular blade region to which the fluid flows. Depending on the thickness of the outer ring, whether the flanges are inset, and the extent to which the downstream end of the flow constrainer extends axially beyond the outer ring, the annular exit space may be slightly larger than the annular blade region because the blades on the hub must have clearance from the inner surface of the housings in order to rotate freely.

Emerging at the annular exit space, the fluid flows to the annular blade region of the impeller of the second axial flow turbomachine. Constraining and directing the fluid in this fashion is designed to eliminate impinging flow on the hub or nose cone of the second axial flow turbomachine, improving efficiency of the system and reducing the uneven loading of the fluid flow caused by impacts with the hub of the second axial flow turbomachine.

The flow constrainer thus acts as a baffle, preventing fluid flowing through the blocked space between the drive assembly of the first turbomachine and the hub of the second turbomachine and constraining flow to the blades of the impeller. The flow constrainer may be open at both ends, simply occupying the blocked space. Alternatively, its inner region may be sealed closed by a wall or a plurality of walls blocking the interior. In either case, the inner enclosed region may be left empty, or may be filled with a suitable material, such as foam, plastic, sound-reducing material, or the like.

The flow control device mounts between the downstream (or distal) end of the first axial flow turbomachine and the upstream (or proximal) end of the second axial flow turbomachine. In one embodiment, the flow control device has a flow constrainer which may be attached to the downstream end of the first axial flow turbomachine, the second end of the flow constrainer remaining unattached, cantilevered to be positioned close to the upstream hub end of the second axial flow turbomachine. In another embodiment, the flow control device has a flow constrainer disposed centrally, and a coaxially concentric outer ring attached thereto via a plurality of struts.

In some embodiments, the flow control device's outer ring is designed to position the flow control device between the two turbomachines. In some embodiments, the outer ring has flanges on both of its sides, which provide attachment points to the flanges of the two turbomachine housings such that when the flanges of the flow control device are attached to the flanges of both housings, the flow control device is securely mounted between the two turbomachine housings and forms a continuous path for fluid flow. The flanges on the outer ring optionally have rubber boots, gaskets, or the like, attached thereto in order to provide vibration damping between the two housings. Such rubber boots allow for a mechanical connection of the flow control device between the two turbomachines, while providing flexibility to dampen structural and acoustic vibrations within the system. The outer ring has an inner diameter generally ranging from substantially the same as the blade tip to blade tip diameter of the impellers, up to the inner diameter of the housings.

In another embodiment, the outer ring is equipped on its outermost circumference with attachment points for attaching directly to the inside of the housing(s), such as threaded holes adapted to receive screws or bolts which would attach and fix the flow control device within the turbomachine housing(s). Alternatively, the flow control device may be secured to the inner surface of the housing by welding, adhesives, or other means known in the art. In this embodiment, the two turbomachines housings may be joined together by their respective flanges directly, with the flow control device mounted inside between the turbomachines. In these embodiments, the outer ring has substantially the same inner diameter as the blade tip to blade tip diameter of the impellers.

In other embodiments, the two turbomachines may both be mounted within a single multiple turbomachine housing, such that each turbomachine's housing is simply a region of the multiple turbomachine housing. The flow control device is mounted between the turbomachines via attachment points, such as threaded holes adapted to receive screws or bolts. Alternatively, the flow control device may be secured to the inner surface of the housing by welding, adhesives, or other means known in the art.

The flow constrainer is connected to the outer ring by struts, typically three or more. In some applications, these struts serve only to maintain the position of the flow constrainer between the two turbomachines. In other applications, the struts may be configured as stator vanes, imbuing the flow control device with the ability not only to constrain the fluid to the periphery and away from the center, but also to direct the fluid flow in a more uniform direction toward the impeller of the second turbomachine. The stator vanes may be straight or angled, and may be rectangular, trapezoidal, elliptical, airfoil, or other shape in cross-section depending on the application. The stator vanes on the outer surface of the flow constrainer may be aligned with the longitudinal axis of the flow constrainer, or may curve thereupon. Preferably, the number of stator vanes in the flow control device is different from the number of stator vanes which may be present in the turbomachines themselves, in order to minimize any potential flow problems such as resonance and vibration. More preferably, the number of stator vanes is not an even multiple of the number of stator vanes on either of the turbomachines, and the flow control device is positioned such that none of its stator vanes line up with colinearly with those of the turbomachines.

Other types of flow straightening devices may be used such as cell type straighteners with rectangular cells, or other duct passages laid along the axis of the main fluid stream to mitigate the lateral velocity components caused by flow disturbances.

The struts provide a mechanical connection for the flow constrainer to the outer ring. In embodiments in which the struts are stator vanes, they also reduce or eliminate non-uniform flow problems such as pre-swirl or co-swirl in the fluid flow entering the second axial flow turbomachine caused by the rotational motion of the rotor blades of the first axial flow turbomachine. Stator vanes may also be used to impart desirable pre-swirl flow characteristics, depending on the application. The stator vanes help to reduce or eliminate uneven loading conditions on the motor assembly bearings in the second turbomachine which may otherwise lead to bearing and/or motor failure.

In another embodiment of the invention, the flow control device has no outer ring, but instead the flow control device is a flow constrainer with attachment points permitting direct attachment to the downstream end of the first axial flow turbomachine, cantilevered and extending toward the upstream hub end of the second axial flow turbomachine. The housings of the two turbomachines are joined by their flanges, with the flow control device situated inside between the two turbomachines. In this embodiment, the flow control device may still be equipped with stator vanes attached thereto, the outer edges of which are free and unattached.

All elements of the flow control device may be fabricated from a variety of materials for different applications including, but not limited to, metal, plastic, rubber, resin, polymer, and carbon fiber. In some embodiments of the present invention, all the elements are constructed from the same material. In other embodiments, the flow constrainer, the outer ring, and the struts may each be fabricated from different materials. In some embodiments, it may be desirable to control vibration in the system. Optional boots may be attached to the flanges of the flow control device on the sides facing the housings to provide such vibration dampening. Such boots may be constructed from rubber, formable viscoelastic polymer, or other such vibration-damping material.

Figure 1:
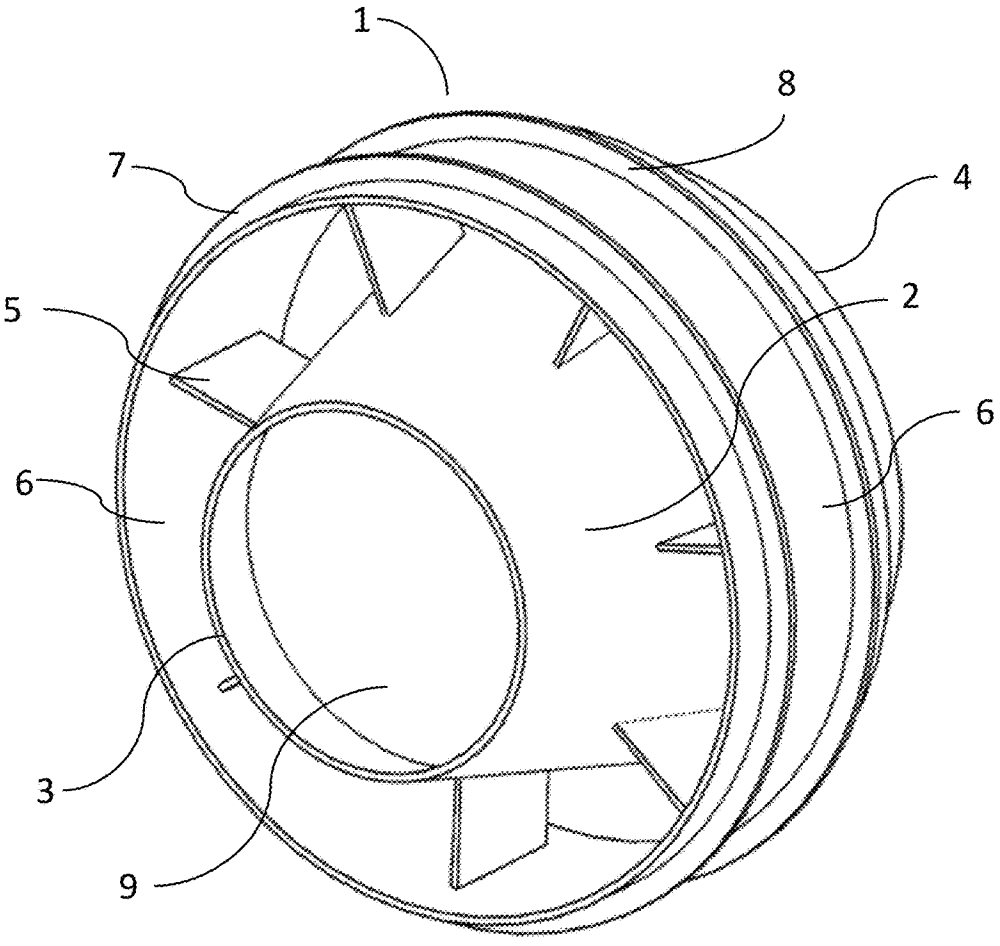
FIG. 1 depicts a perspective view of an embodiment of the flow control device for axial flow turbomachines in series.

The flow constrainer may be truncated conical shaped as shown in FIGS. 1 and 2, or may be any gradually curved shape that provides a smooth transition of the fluid flow to the blades of the second axial flow turbomachine. The flow constrainer may have an axial cross-section that is straight (e.g., for a cylindrical transition between axial flow turbomachines), sloped (e.g., for a conical transition between axial flow turbomachines), parabolic, semi-parabolic, hyperbolic, quadric, ogee, or the like. The shape of the flow constrainer may be a compound topology being a combination of such shapes as well. Such an embodiment is shown in, for example, FIGS. 3, 6, and 7, in which the proximal end has a cylindrical portion which transitions to a conical topology throughout the remainder of the flow constrainer.

Figure 9:
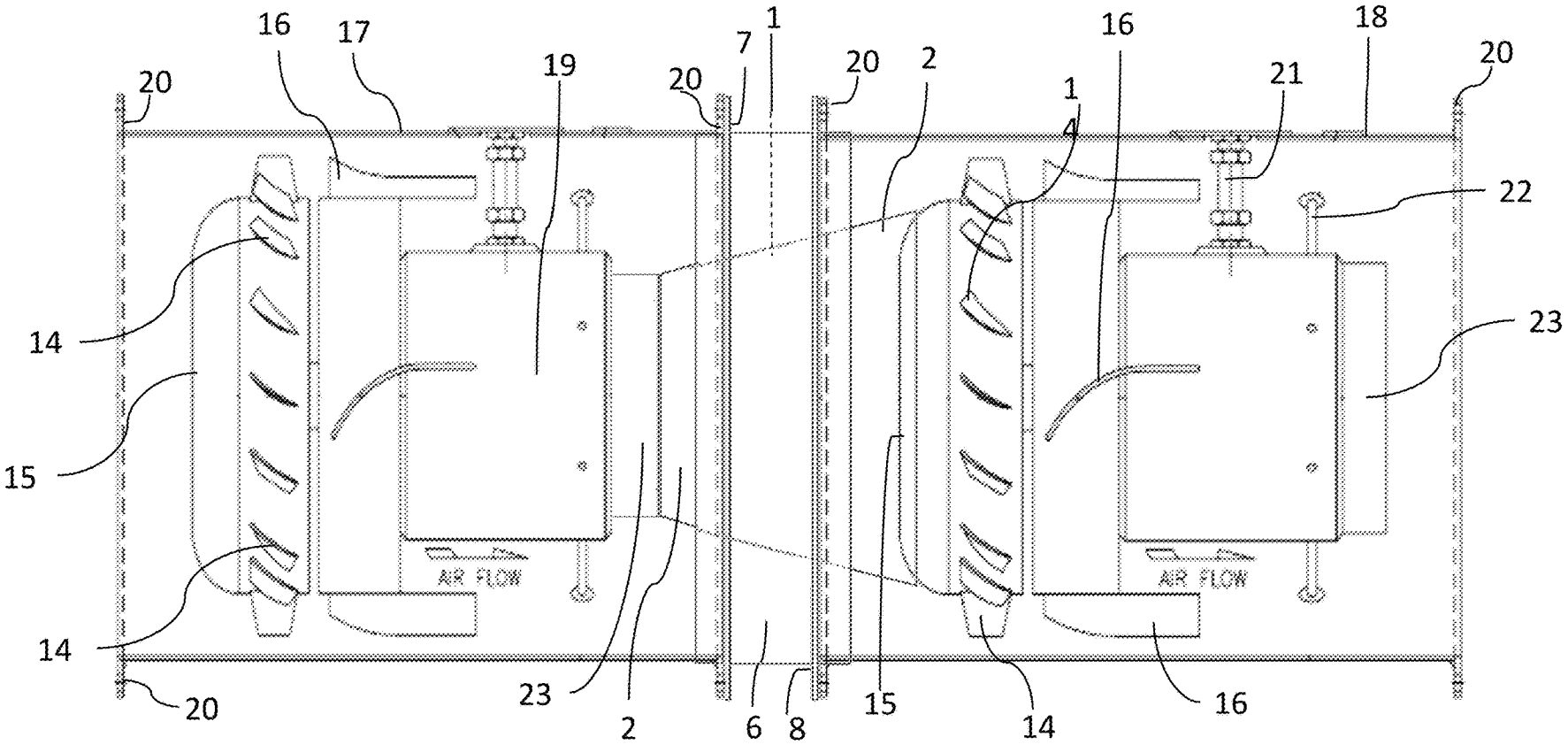

With reference to the Drawings, FIG. 1 shows a perspective view of an embodiment of the flow control device 1 having a truncated conical flow constrainer 2 and an outer ring 6. The flow constrainer 2 has an upstream or proximal end 3 and a downstream or distal end 4. The flow constrainer 2 is connected to the outside ring 6 by struts in the form of stator vanes 5. The outer ring 6 has attachment points in the form of flange 7 and flange 8, inset around the outer ring 6 for attaching to the first turbomachine housing 17 and the second turbomachine housing 18 (as shown in FIG. 9) such that the housings overlap the outer surface of the outer ring.

FIG. 2 shows a side view of a similar embodiment of the flow control device 1 with conical flow constrainer 2 and outer ring 6. Fluid flows from left to right in the view of FIG. 2, and the flow constrainer 2 constrains the fluid to emerge on the downstream right side in an annular exit space 10 with an annular shape, namely the space surrounding the flow constrainer 2 between it and the turbomachine housings 17, 18 shown in FIGS. 11 and 12. The annular exit space 10 has approximately the same dimensions as the annular blade region to which the fluid flows. Because the blades 14 on the hub 15 must have clearance from the inner surface of the housings 17, 18 in order to rotate freely, the annular exit space 10 may be slightly larger than the annular blade region.

Figure 4:
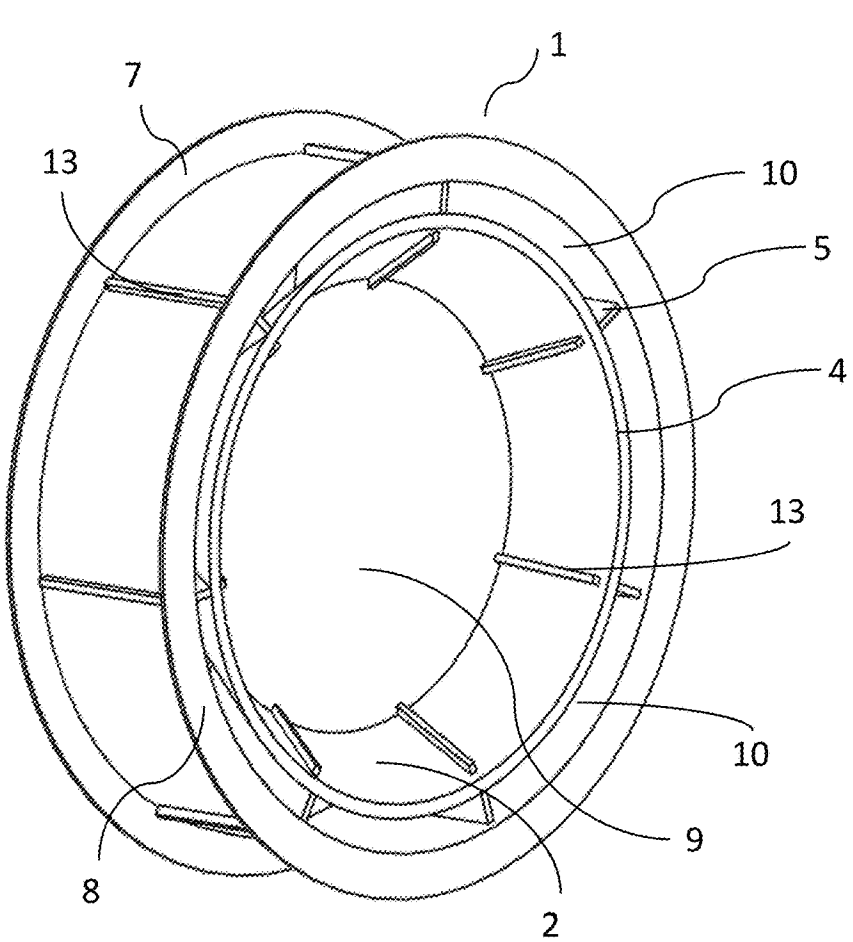
FIGS. 3 and 4 depict perspective views of embodiments of the flow control device for axial flow turbomachines in series.
Figure 3:
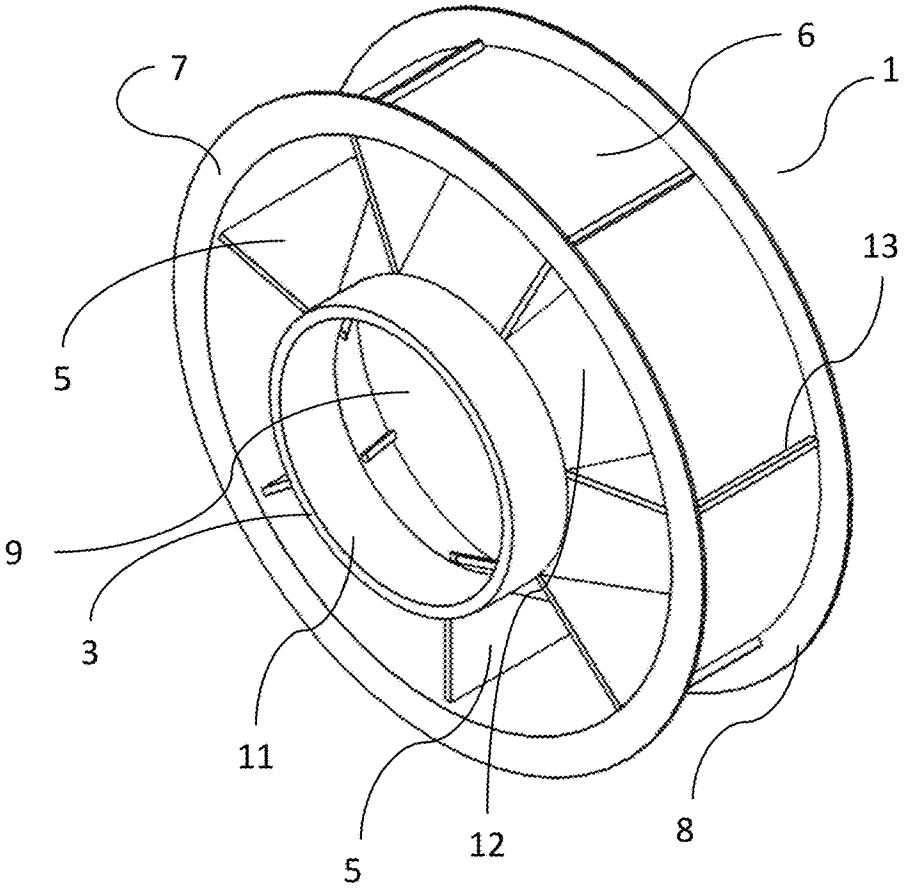

A flow constrainer with a compound shape is an embodiment shown in FIGS. 3 and 4, in which the flow constrainer 2 has a cylindrical portion 11 at its proximal end 3, and a truncated conical portion 12 for the remainder of the length of the flow constrainer until its distal end 4. Struts configured as stator vanes 5 are attached to the flow constrainer 2 and the outer ring 6. Where such attachments are welds, it may be preferable to have the welds outside the fluid flow region, in which case the stator vanes 5 may pass through the surfaces of the flow constrainer 2 and the outer ring 6 and be welded at the interior of the flow constrainer 2 and the exterior of the outside ring 6 as shown by the welding sites 13. A wall 9 prevents any stray fluid from passing through the flow constrainer from either side. The exit space 10 is a narrow annular space where the fluid flow has been constrained by the flow control device 1. The outer ring 6 has attachment points in the form of flange 7 and flange 8, flush with the edges of the outer ring 6 for attaching to the first turbomachine housing 17 and the second turbomachine housing 18 (as shown in FIG. 8).

Figure 7:
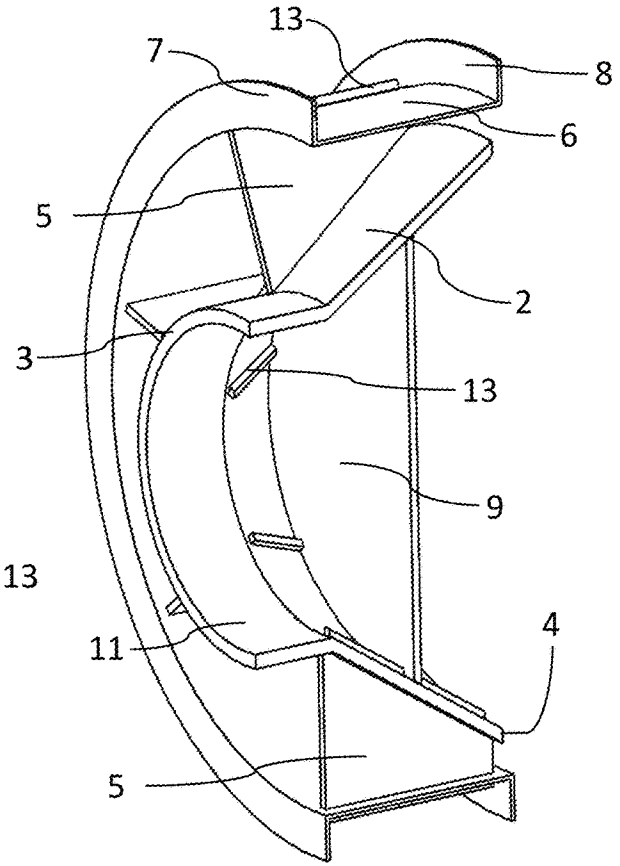
FIGS. 5-7 depict cutaway perspective views of embodiments of the flow control device for axial flow turbomachines in series.
Figure 6:
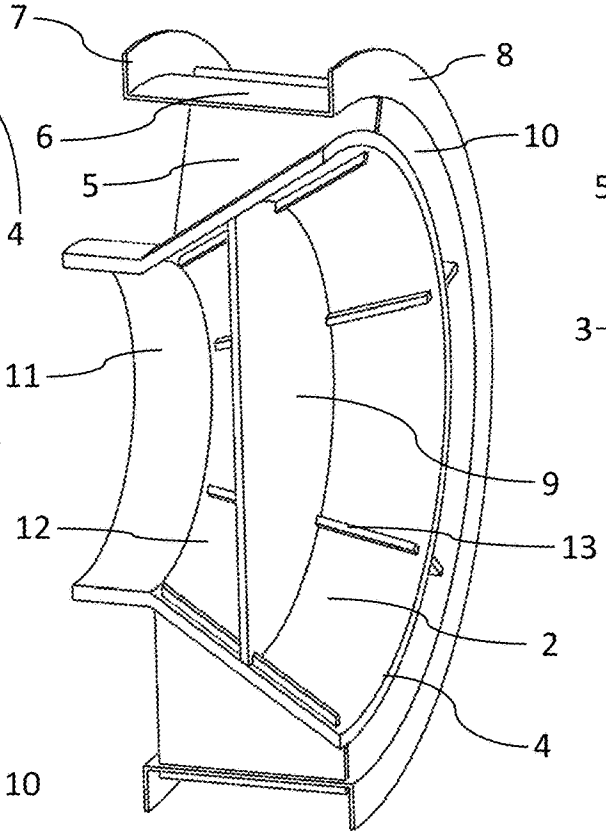
Figure 5:
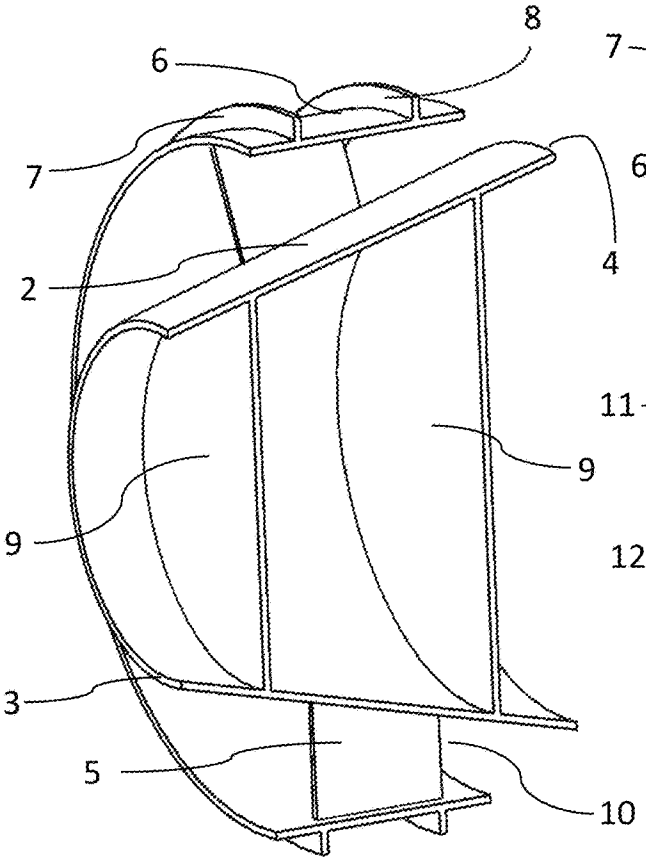

FIG. 5 shows a cutaway view of an embodiment having a conical flow constrainer 2, two walls 9, and inset flanges 7, 8. The flow constrainer has two walls 9 blocking fluid flow. FIGS. 6 and 7 show cutaway views of an embodiment having a compound topology similar to the embodiments shown in FIGS. 3 and 4, having an upstream cylindrical portion 11 and a trailing truncated conical portion 12. A single wall 9 is used in this embodiment, along with flush flanges 7, 8.

Figure 8:
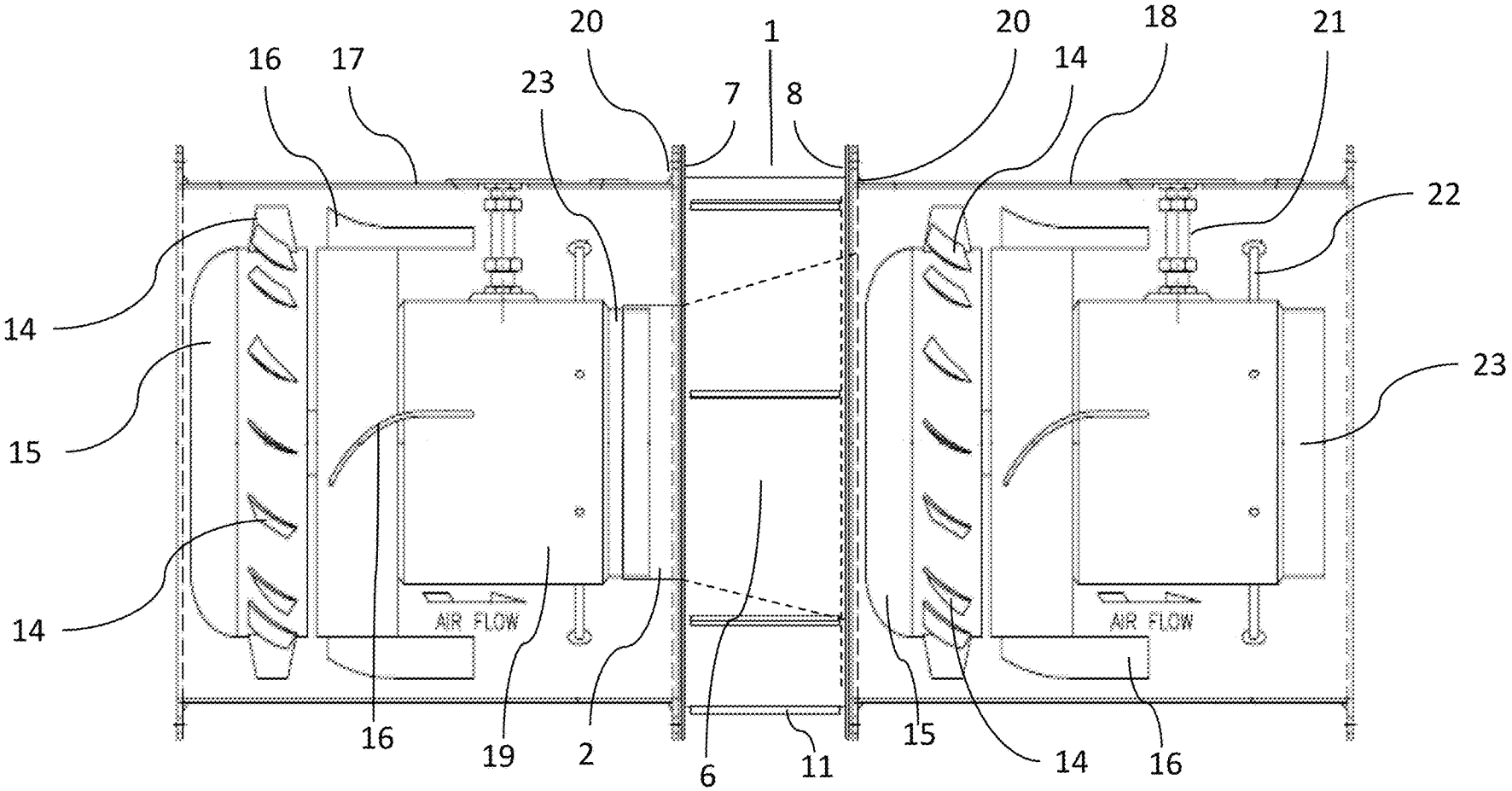
FIGS. 8 and 9 depict side views of embodiments of the flow control device mounted between two axial flow turbomachines.

Examples of the flow control device 1 mounted between axial flow turbomachines are shown in FIGS. 8 and 9. FIG. 8 illustrates the use of a flow control device 1 having a flow constrainer 2 with compound topology, a cylindrical proximal portion and the remainder a truncated conical portion, and the outer ring 6 has flush flanges 7, 8. FIG. 9 illustrates the use of a flow control device 1 having a flow constrainer 2 with a truncated conical topology, and the outer ring 6 has inset flanges 7, 8. Fluid flows from left to right. The first turbomachine's impeller, with blades 14 attached to a rotating hub 15, accelerates the fluid which flows past stator vanes 16 and around the drive assembly 19, constrained by the drive assembly 19 and the first turbomachine housing 17, finally reaching the end of the drive assembly 23. The drive assemblies 19 are supported within their respective housings 17, 18, by drive assembly supports 22. Conduit 21 provides any necessary electrical or mechanical connections to motors or drive elements within the drive assemblies. The flow control device is mounted between the housings 17, 18 by its flanges 7, 8, which mate to the housings flanges 20. The flow control device is thus positioned precisely between the housed turbomachines.

Following the fluid flow flowing past the end of the drive assembly 23, the fluid then encounters the flow control device 1. The proximal upstream end 3 of the flow constrainer 2 is matched in diameter to the end of the drive assembly 23, thus the fluid is constrained to the available space between the outer surface of the flow constrainer 2 and the inside surface of the outer ring 6. Fluid reaches the distal downstream end 4 of the flow constrainer 2, which is matched to the diameter of the hub 15 of the second axial flow turbomachine. Emerging from the flow constrainer 2, the fluid flow is delivered to the blades 14 of the second turbomachine, constrained by the hub and the second turbomachine housing 18.

The following Examples serve to illustrate the present invention and are not intended to limit its scope in any way.

Examples

Example 1-a Flow Control Device for Axial Flow Turbomachines in Series for Air A flow control device was constructed from aluminum. The device is equipped with flanges on both sides to mate with the flanges of a typical 21 inch diameter housing with an axial flow turbomachine, in particular, an axial fan, housed within. The device was mounted between two such housed axial fans, on one side to the downstream end of the first axial fan housing, and on the other side to the upstream end of the second axial fan housing. The flow constrainer's first end was 12 inches in diameter to match the 12 inch diameter of the non-rotating downstream end of the first axial fan's motor, and was measured to rest one half inch from the motor. The flow constrainer's second end was 18 inches in diameter to match the 18 inch diameter of the rotating hub of the second axial fan, and was measured to rest one half inch from the hub. The flow control device also was equipped with seven straight stator vanes with rectangular cross section equally spaced around the flow constrainer, joined to both the flow constrainer and to the outer ring. The outer ring had one inch high flanges on both sides, for connecting to the one inch flanges on both axial fans' housings. In operation, it was observed that the air flow was constrained outside the center, could not significantly impact the hub of the second axial fan, and was directed into the blade region of the second axial fan's impeller. It was observed that the air pressure downstream of the second fan was increased approximately two-fold over that produced by the same pair of axial fans in series without the flow control device of the invention. It was also observed that mechanical stress on the system was reduced.

Example 2-a Flow Control Device for Axial Flow Turbomachines in Series for Air, with Stator Vanes A flow control device is fabricated from aluminum. The device is equipped with flanges on both sides to mate with the flanges of axial flow turbomachine housings. In this Example, the flow control device is mounted between two housed axial flow turbomachines (in this case, axial fans), on one side to the downstream end of the first axial fan housing, and on the other side to the upstream end of the second axial fan housing. The flow constrainer's first end matches the non-rotating downstream end of the first axial fan's motor. The flow constrainer's second end matches the diameter of the rotating hub of the second axial fan. The flow control device has stator vanes with a curved cross section defined by a camber line advantageous to the inlet flow conditions, equally spaced around the flow constrainer, joined to both the flow constrainer and to the outer ring. The stator vanes are situated in such a way as to provide advantageous pre-swirl to the downstream fan impeller inlet to ease the aerodynamic load on the downstream impeller assembly. The outer ring has flanges on both sides, for connecting to the flanges on both axial fans' housings. It is observed that the air pressure downstream of the second fan is increased over that produced by the equivalent pair of axial fans in series without the flow control device of the invention. It is also observed that mechanical stress on the system is reduced.

Example 3-a Cantilevered Flow Control Device for Ducted Axial Propulsors in Series, for Water A flow control device is fabricated from steel. In this Example, the axial flow turbomachines are ducted propulsors. The flow control device is a flow constrainer equipped with mounting points on its proximal end for attaching to the end of the non-rotating drive assembly of a first axial propulsor. The flow control device is mounted between two axial propulsors. At the downstream end of the first ducted propulsor, the proximal end of the flow control device and flow constrainer, which matches the diameter of the end of the drive assembly, is attached to the end of the drive assembly. The flow control device is cantilevered to bring the distal end of the flow constrainer into close proximity to the second axial propulsor. The flow constrainer's distal end matches the diameter of the rotating hub of the second axial propulsor. The flow control device has stator vanes with a curved cross section defined by an airfoil shape advantageous to the inlet flow conditions, equally spaced around the flow constrainer, joined to the flow constrainer. The outer edges of the stator vanes are unattached. Optionally, the outer edges of the stator vanes may be attached directly to the inner surface of the housings. It is observed that the water pressure downstream of the second propulsor is increased over that produced by the equivalent pair of axial propulsors in series without the flow control device of the invention. It is also observed that mechanical stress on the system is reduced.

The present invention is not to be limited in scope by the specific embodiments described above, which are intended as illustrations of aspects of the invention. Functionally equivalent methods and components are within the scope of the invention. Various modifications of the invention, in addition to those shown and described herein, will be readily apparent to those skilled in the art from the foregoing description. Such modifications are intended to fall within the scope of the appended claims. All cited documents are incorporated herein by reference.

What is claimed is:

1. A flow control device for constraining fluid flow between high hub to tip ratio axial flow turbomachines in series comprising:

a flow constrainer having a first end and a second end, the first end having a diameter substantially equal to a diameter of a drive assembly of a first high hub to tip ratio axial flow turbomachine housed in a first housing, and the second end having a diameter substantially equal to a diameter of a hub of a second high hub to tip ratio axial flow turbomachine housed in a second housing, the flow constrainer being attached only to the first housing, or only to the second housing;

wherein, when the first and second housings are joined and the flow control device is situated between the first and second high hub to tip ratio axial flow turbomachines, the flow constrainer occupies a volume defined by substantially all the space extending between the drive assembly of the first high hub to tip ratio axial flow turbomachine and the hub of the second high hub to tip ratio axial flow turbomachine, and the flow control device constrains fluid flow downstream of the first high hub to tip ratio axial flow turbomachine to a plurality of blades attached to the hub of the second high hub to tip ratio axial flow turbomachine.

2. The flow control device of claim 1, further comprising a plurality of stator vanes attached to an outer surface of the flow constrainer, the stator vanes having a cross section topology selected from the group consisting of a rectangle, a trapezoid, an ellipse, and an airfoil.

3. The flow control device of claim 2, wherein the stator vanes curve upon the outer surface of the flow constrainer.

4. The flow control device of claim 1, wherein the flow constrainer comprises a substantially rigid material.

5. The flow control device of claim 4, wherein the substantially rigid material is selected from the group consisting of metal, plastic, rubber, resin, polymer, and carbon fiber.

6. The flow control device of claim 5, wherein the flow constrainer has a topology selected from the group consisting of cylindrical, truncated conic, parabolic, semi-parabolic, hyperbolic, quadric, ogee, and compound.

7. The flow control device of claim 1, further comprising an outer ring coaxially concentric with the flow constrainer, the outer ring being connected to the flow constrainer by a plurality of struts, and the outer ring having attachment points for attaching to at least one of the first and second housings.

8. The flow control device of claim 7, wherein the plurality of the struts are stator vanes.

9. The flow control device of claim 8, wherein the stator vanes have a cross section topology selected from the group consisting of a rectangle, a trapezoid, an ellipse, and an airfoil.

10. The flow control device of claim 8, wherein the stator vanes curve upon an outer surface of the flow constrainer.

11. The flow control device of claim 7, wherein the attachment points comprise flanges for attaching to the first and second housings.

12. The flow control device of claim 7, wherein the first and second housings are a first and second stage, respectively, of a single multiple turbomachine housing.

13. A method of constraining fluid flow between the first and the second high hub to tip ratio axial flow turbomachine comprising mounting a flow control device of claim 7 between the first and second axial flow turbomachines, wherein the fluid flow is constrained and directed to the blades of the second axial flow turbomachine.

14. The flow control device of claim 1, wherein the fluid is selected from the group consisting of air and water.

15. The flow control device of claim 1, wherein the drive assembly comprises a motor.

16. The flow control device of claim 1, wherein the first and second housings are a first and second stage, respectively, of a single multiple turbomachine housing.

17. A method of constraining fluid flow between the first and the second high hub to tip ratio axial flow turbomachine comprising mounting a flow control device of claim 1 between the first and second axial flow turbomachines, wherein the fluid flow is constrained and directed to the blades of the second axial flow turbomachine.

* * * * *